US010851780B2

(12) United States Patent
Yosuke et al.

(10) Patent No.: US 10,851,780 B2
(45) Date of Patent: Dec. 1, 2020

(54) SCROLL COMPRESSOR

(71) Applicant: DAIKIN INDUSTRIES, LTD., Osaka (JP)

(72) Inventors: Yoshinobu Yosuke, Osaka (JP); Takashi Uekawa, Osaka (JP); Yongsheng Zhao, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/328,106

(22) PCT Filed: Jun. 28, 2017

(86) PCT No.: PCT/JP2017/023781
§ 371 (c)(1),
(2) Date: Feb. 25, 2019

(87) PCT Pub. No.: WO2018/042854
PCT Pub. Date: Mar. 8, 2018

(65) Prior Publication Data

US 2019/0186489 A1 Jun. 20, 2019

(30) Foreign Application Priority Data

Aug. 31, 2016 (JP) ..... 2016-169771

(51) Int. Cl.
*F04C 18/02* (2006.01)
*F04C 29/00* (2006.01)
(Continued)

(52) U.S. Cl.
CPC ..... *F04C 18/0215* (2013.01); *F04C 18/02* (2013.01); *F04C 23/008* (2013.01);
(Continued)

(58) Field of Classification Search
None
See application file for complete search history.

(56) References Cited

U.S. PATENT DOCUMENTS 5,040,958 A * 8/1991 Arata ..... F04C 18/0215 418/151
5,090,878 A * 2/1992 Haller ..... F04C 29/0021 418/1
(Continued)

FOREIGN PATENT DOCUMENTS

CN 101761477 A 6/2010
JP 9-32752 A 2/1997
(Continued)

OTHER PUBLICATIONS

International Search Report of corresponding PCT Application No. PCT/JP2017/023781 dated Aug. 8, 2017.
(Continued)

*Primary Examiner* — Peter J Bertheaud
*Assistant Examiner* — Geoffrey S Lee
(74) *Attorney, Agent, or Firm* — Global IP Counselors, LLP

(57) ABSTRACT

A scroll compressor includes a compression mechanism having fixed and movable scrolls forming a compression chamber, a motor to drive the movable scroll, a drive shaft, a casing, a housing accommodated inside the casing, and a floating member supported by the housing. The casing accommodates the compression mechanism, the motor, and the drive shaft. The floating member can be pushed toward the movable scroll by a pressure in a back pressure space formed between the floating member and the housing. The floating member may include a plurality of supported portions arranged circumferentially at three or more locations, and the housing may include a supporting portion supporting the supported portions. Alternatively, the floating member may include a body member and an outer peripheral member separate from the body member, the outer peripheral mem-
(Continued)

ber mounted to an outer periphery of the body member, and the housing supports the outer peripheral member.

5 Claims, 7 Drawing Sheets

(51) Int. Cl.
*F04C 27/00* (2006.01)
*F04C 23/00* (2006.01)

(52) U.S. Cl.
CPC ..... *F04C 27/005* (2013.01); *F04C 29/0021* (2013.01); *F04C 2210/22* (2013.01); *F04C 2230/603* (2013.01); *F04C 2240/10* (2013.01); *F04C 2240/80* (2013.01)

(56) References Cited

U.S. PATENT DOCUMENTS 5,791,887 A * 8/1998 Williams ..... F04C 18/0246 418/55.2
6,056,523 A * 5/2000 Won ..... F04C 23/008 418/15
6,135,739 A * 10/2000 Ogawa ..... F04C 23/008 418/14
6,582,210 B2 * 6/2003 Sano ..... F04C 18/0215 418/55.1
6,679,690 B2 * 1/2004 Fushiki ..... F04C 23/008 418/149
6,709,247 B1 * 3/2004 Clendenin ..... F04C 23/008 384/215
7,021,912 B2 * 4/2006 Tsuchiya ..... F04C 29/0021 418/55.1
7,070,401 B2 * 7/2006 Clendenin ..... F01C 1/0215 418/55.1
7,322,807 B2 * 1/2008 Clendenin ..... F01C 1/0215 418/55.1
7,331,774 B2 * 2/2008 Ueda ..... F04C 27/005 418/104
7,458,788 B2 * 12/2008 Iwano ..... F04C 18/0215 418/55.3
9,689,391 B2 * 6/2017 Fu ..... F04C 29/063
9,797,400 B2 * 10/2017 Yun ..... F04C 27/005
2003/0031576 A1 * 2/2003 Fushiki ..... F04C 23/008 418/55.5
2003/0082064 A1 * 5/2003 Sano ..... F04C 18/0215 418/55.1
2004/0219048 A1 * 11/2004 Tsuchiya ..... F04C 29/0021 418/55.4
2005/0025652 A1 2/2005 Kuo
2005/0201883 A1 * 9/2005 Clendenin ..... F01C 1/0215 418/55.5
2006/0233655 A1 * 10/2006 Clendenin ..... F01C 1/0215 418/55.1
2008/0101973 A1 * 5/2008 Iwano ..... F04C 18/0215 418/55.1
2013/0251574 A1 * 9/2013 Heusler ..... F01C 17/066 418/55.3
2014/0271306 A1 * 9/2014 Kim ..... F04C 18/023 418/55.4
2015/0152868 A1 * 6/2015 Fu ..... F04C 29/063 418/55.5
2015/0316057 A1 * 11/2015 Yun ..... F04C 27/005 418/55.1
2017/0292518 A1 * 10/2017 Stover ..... F04C 29/063
2017/0292519 A1 * 10/2017 Stover ..... F04C 29/063

FOREIGN PATENT DOCUMENTS

JP 2000-337276 A 12/2000
JP 2003-129968 A 5/2003
WO 97/44585 A1 11/1997

OTHER PUBLICATIONS

International Preliminary Report of corresponding PCT Application No. PCT/JP2017/023781 dated Mar. 14, 2019.
European Search Report of corresponding EP Application No. 17 84 5864.2 dated May 8, 2019.

* cited by examiner

SCROLL COMPRESSOR

CROSS-REFERENCE TO RELATED APPLICATIONS

This U.S. National stage application claims priority under 33 U.S.C. § 119(a) to Japanese Patent Application No. 2016-169771, filed in Japan on Aug. 31, 2016, the entire contents of which are hereby incorporated herein by reference.

TECHNICAL FIELD

The present invention relates to a scroll compressor. More specifically, the present invention relates to a scroll compressor in which a floating member presses a movable scroll against a fixed scroll.

BACKGROUND ART

JP 2000-337276A discloses a known scroll compressor in which a floating member (corresponding to a compliant frame in JP 2000-337276A) presses a movable scroll against a fixed scroll to reduce a leakage loss of a refrigerant from spiral distal ends of the scrolls.

In the scroll compressor disclosed in JP 2000-337276A, an upper clearance between an outer peripheral side face of a floating member and an inner peripheral side face of a housing is equal in width to a lower clearance between the outer peripheral side face of the floating member and the inner peripheral side face of the housing. Due to this structure, the scroll compressor operates with a high degree of efficiency without a leakage loss. Also, due to the structure, the scroll compressor operates without partial contact at a movable scroll hearing and a main bearing.

SUMMARY

According to the scroll compressor disclosed in JP 2000-337276 A, the outer peripheral side face of the floating member is opposed to the inner peripheral side face of the housing, Therefore, the outer peripheral side face of the floating member requires highly accurate processing for preventing partial contact of the floating member with the housing. With regard to the partial contact of the floating member with the housing, for example, strain in assembling the floating member also needs to be taken into consideration in addition to the processing accuracy for the floating member, which may cause an increase in number of man-hours for assembly and manufacture.

The present invention provides a scroll compressor in which a floating member presses a movable scroll against a fixed scroll, the scroll compressor being capable of reducing inclination of the floating member and being capable of reducing the number of man-hours for assembly and manufacture.

According to a first aspect of the present invention, a scroll compressor includes a compression mechanism, a motor, a drive shaft, a casing, a housing, and a floating member. The compression mechanism includes a fixed scroll and a movable scroll. The fixed scroll includes a fixed-side wrap having a spiral shape. The movable scroll includes a movable-side wrap having a spiral shape, the movable-side wrap being combined with the fixed-side wrap to define a compression chamber. The compression mechanism is configured to discharge a refrigerant compressed in the compression chamber. The motor is configured to drive the movable scroll to cause the movable scroll to revolve relative to the fixed scroll. The drive shaft couples the movable scroll to the motor. The casing accommodates therein the compression mechanism, the motor, and the drive shaft. The housing is accommodated in the casing. The floating member is supported by the housing. The floating member is pushed toward the movable scroll by a pressure in a back pressure space between the floating member and the housing to press the movable scroll against the fixed scroll.

In the scroll compressor according to the first aspect of the present invention, (A) the floating member includes a plurality of supported portions arranged circumferentially. The housing includes a supporting portion. The supporting portion supports the supported portions of the floating member such that the floating member is slidable in an axial direction of the drive shaft.

In the scroll compressor according to the first aspect of the present invention, alternatively, (B) the floating member includes a body member and an outer peripheral member separate from the body member. The outer peripheral member is mounted to an outer periphery of the body member. The housing supports the outer peripheral member such that the floating member is slidable in the axial direction of the drive shaft.

According to the first aspect of the present invention, in the scroll compressor having the configuration (A), the floating member is not supported at its outer peripheral side face by the housing at its inner peripheral side face, but the plurality of supported portions of the floating member are supported by the corresponding supporting portion of the housing. Ensuring accuracy, such as processing accuracy and mounting accuracy, for the supported portions and the supporting portion is relatively easier than ensuring accuracy for the entire outer periphery of the floating member. The scroll compressor having this configuration is therefore capable of reducing inclination of the floating member and is also capable of reducing the number of man-hours for assembly and manufacture.

According to the first aspect of the present invention, in the scroll compressor having the configuration (B), the body member of the floating member is assembled into the scroll compressor, and then the outer peripheral member is mounted to the body member. Accuracy, such as roundness, for the outer peripheral member is therefore ensured even when the body member undergoes, for example, strain in assembling the body member. The scroll compressor having this configuration is consequently capable of reducing inclination of the floating member and is also capable of reducing the number of man-hours for assembly and manufacture.

According to a second aspect of the present invention, in the scroll compressor according to the first aspect, each of the supported portions is a bush disposed on the floating member. The supporting portion includes bolts respectively inserted into the bushes.

According to the second aspect of the present invention, in the scroll compressor, the bolts of the supporting portion are respectively inserted into the bushes serving as the supported portions with ease even when an axis of each bush is not aligned with an axis of the corresponding bolt. This configuration therefore improves ease of assembly of the scroll compressor.

According to a third aspect of the present invention, in the scroll compressor according to the second aspect, the floating member further includes a bearing pivotally supporting the drive shaft. A ratio of a distance from a center of each bush to a center of the movable-side wrap in the axial direction of the drive shaft to a distance from a center of the bearing to the center of each bush in the axial direction of the drive shaft falls within a range from 0.5 or more to 1.5 or less.

According to the third aspect of the present invention, the scroll compressor cancels out a rotation moment around each bush to reduce inclination of the floating member relative to the movable scroll. According to the third aspect, the scroll compressor therefore operates with good efficiency by reducing a refrigerant leakage from a clearance between a distal end of a wrap and an end plate in a scroll.

According to a fourth aspect of the present invention, in the scroll compressor according to the first aspect, each of the supported portions is a ring disposed on the floating member. The supporting portion includes control pins respectively inserted into the rings.

According to the fourth aspect of the present invention, the scroll compressor is capable of reducing inclination of the floating member and is also capable of reducing the number of man-hours for assembly and manufacture, with a relatively simple structure.

According to a fifth aspect of the present invention, in the scroll compressor according to the first aspect, each of the supported portions is a recess or a protrusion disposed in or on the floating member. The supporting portion includes protrusions disposed on the housing and respectively fitted to the recesses in the floating member, or recesses disposed in the housing and to which the protrusions on the floating member are respectively fitted.

According to the fifth aspect of the present invention, the scroll compressor is capable of reducing inclination of the floating member and is also capable of reducing the number of man-hours for assembly and manufacture, with a relatively simple structure.

According to a sixth aspect of the present invention, in the scroll compressor according to any of the first to fifth aspects, the floating member includes a pressing portion having a cylindrical shape. The pressing portion extends toward the movable scroll. The pressing portion has on its end a thrust surface to be brought into contact with the movable scroll. The pressing portion has in its all-around inner face a groove. In the scroll compressor, a relation of $(D/T)^2/(L/T)^3 \leq 0.6$, where T represents a thickness of the thrust surface in a radial direction of the pressing portion, L represents a length from the thrust surface to the groove in the axial direction of the drive shaft, and D represents a depth of the groove in the radial direction of the pressing portion, is satisfied.

According to the sixth aspect of the present invention, in the scroll compressor, the thrust surface of the floating member inclines while following inclination of the movable scroll. This configuration thus reduces occurrence of partial contact of the movable scroll with the thrust surface of the floating member.

The present invention provides a scroll compressor capable of reducing inclination of a floating member and capable of reducing the number of man-hours for assembly and manufacture.

DETAILED DESCRIPTION OF EMBODIMENT(S)

A scroll compressor according to an embodiment of the present invention will be described below with reference to the drawings. It should be noted that embodiments to be described below are merely illustrative and may be appropriately modified without departing from the scope of the present invention.

Figure 1:
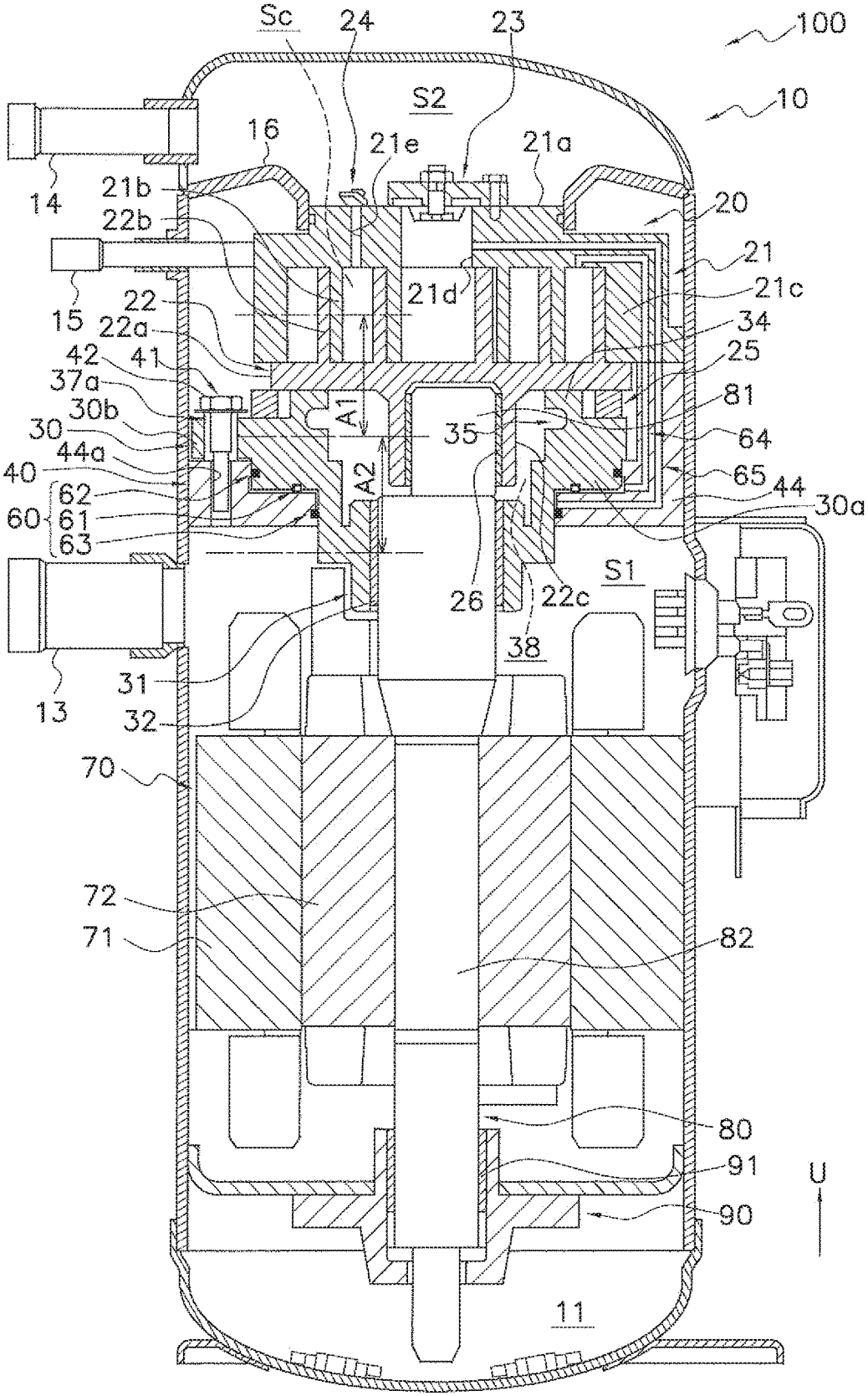
FIG. 1 is a schematic longitudinal sectional view of a scroll compressor according to a first embodiment of the present invention.

Terms including "upper", "lower", and others may be used for the sake of description on directions and arrangement under the definition that an arrow U in FIG. 1 is directed upward, unless otherwise specified.

In the following description, terms including "parallel", "orthogonal", "horizontal", "vertical", "identical", and others do not intend to represent strictly parallel, orthogonal, horizontal, vertical, identical, and other relationships. The terms including "parallel", "orthogonal", "horizontal", "vertical", "identical", and others involve substantially parallel, orthogonal, horizontal, vertical, identical, and other relationships.

First Embodiment (1) General Configuration

A description will be given of a scroll compressor 100 according to a first embodiment of the present invention. The scroll compressor 100 is a so called fully hermetic compressor. The scroll compressor 100 is configured to suck, compress, and discharge a refrigerant. A non-limiting example of the refrigerant is a hydrofluorocarbon (HFC) refrigerant such as R32. It should be noted that R32 is merely an example of the refrigerant, and the scroll compressor 100 may be configured to compress and discharge any refrigerant in addition to R32.

The scroll compressor 100 is used in a refrigeration apparatus. For example, the scroll compressor 100 is installed in an outdoor unit of an air conditioning apparatus to constitute a part of a refrigerant circuit in the air conditioning apparatus.

As illustrated in FIG. 1, the scroll compressor 100 mainly includes a casing 10, a compression mechanism 20, a floating member 30, a housing 40, a seal member 60, a motor 70, a drive shaft 80, and a lower bearing housing 90.

(2) Specific Configuration

A specific description will be given of the casing 10, compression mechanism 20, floating member 30, housing 40, seal member 60, motor 70, drive shaft 80, and lower bearing housing 90 in the scroll compressor 100.

(2-1) Casing

With reference to FIG. 1, the scroll compressor 100 includes the casing 10 having a vertically elongated cylindrical shape. With reference to FIG. 1, the casing 10 accommodates therein various members constituting the scroll compressor 100, such as the compression mechanism 20, the floating member 30, the housing 40, the seal member 60, the motor 70, the drive shaft 80, and the lower bearing housing 90.

The compression mechanism 20 is disposed on an upper side of the casing 10. With reference to FIG. 1, the floating member 30 and the housing 40 are disposed below the compression mechanism 20. The motor 70 is disposed below the housing 40. With reference to FIG. 1, the lower bearing housing 90 is disposed below the motor 70. With reference to FIG. 1, the casing 10 has in its bottom an oil reservoir space 11. The oil reservoir space 11 stores therein a refrigerating machine oil for lubricating, for example, the compression mechanism 20.

The casing 10 is partitioned into a first space S1 and a second space S2. With reference to FIG. 1, the first space S1 and the second space S2 are defined by a partition plate 16 in the casing 10.

The partition plate 16 is a plate member having an annular shape as seen in plan view. The partition plate 16 of the annular shape is fixed at its all-around inner peripheral side to an upper portion of a fixed scroll 21 in the compression mechanism 20 (to be described later). The partition plate 16 is also fixed at its all-around outer peripheral side to an inner face of the casing 10. The partition plate 16 is fixed to the fixed scroll 21 and the casing 10 so as to keep a space below the partition plate 16 and a space above the partition plate 16 hermetic. The space below the partition plate 16 corresponds to the first space S1. The space above the partition plate 16 corresponds to the second space S2.

The first space S1 is a space in which the motor 70 is disposed. The first space S1 is a space into which the refrigerant that is not compressed yet by the scroll compressor 100 flows from the refrigerant circuit, a part of which is constituted of the scroll compressor 100, in the air conditioning apparatus. In other words, the first space S1 is a space into which the low-pressure refrigerant in a refrigeration cycle flows. The second space S2 is a space into which the refrigerant discharged from the compression mechanism 20, that is, the refrigerant compressed by the compression mechanism 20 flows. In other words, the second space S2 is a space into which the high-pressure refrigerant in the refrigeration cycle flows. The scroll compressor 100 is a so called low pressure dome-type scroll compressor.

With reference to FIG. 1, a suction pipe 13, a discharge pipe 14, and an injection pipe 15 are attached to the casing 10 so that the inside of the casing 10 communicates to the outside of the casing 10 through the suction pipe 13, the discharge pipe 14, and the injection pipe 15.

With reference to FIG. 1, the suction pipe 13 is attached to the casing 10 at the middle of the casing 10 in a vertical direction. Specifically, the suction pipe 13 is attached to the casing 10 at a place between the housing 40 and the motor 70 in the vertical direction. The suction pipe 13 causes the outside of the casing 10 to communicate with the first space S1 in the casing 10. In the scroll compressor 100, the refrigerant that is not compressed yet, that is, the low-pressure refrigerant in the refrigeration cycle flows into the first space S1 through the suction pipe 13.

With reference to FIG. 1, the discharge pipe 14 is attached to the casing 10 above the partition plate 16 on the upper side of the casing 10. The discharge pipe 14 causes the outside of the casing 10 to communicate with the second space S2 in the casing 10. The refrigerant flowing into the second space S2 after compression by the compression mechanism 20, that is, the high-pressure refrigerant in the refrigeration cycle, flows out of the scroll compressor 100 through the discharge pipe 14.

With reference to FIG. 1, the injection pipe 15 is attached to the casing 10 below the partition plate 16 on the upper side of the casing 10 so as to penetrate the casing 10. The injection pipe 15 has an end placed in the casing 10, and this end is connected to the fixed scroll 21 of the compression mechanism 20 (to be described later) as illustrated in FIG. 1. The injection pipe 15 communicates with compression chamber Sc being in the midstream of compression in the compression mechanism 20 (to be described later) via a passage (not illustrated) in the fixed scroll 21. The compression chamber Sc, with which the injection pipe 15 communicates and which is in the midstream of compression, receives an intermediate-pressure refrigerant between the low-pressure refrigerant and the high-pressure refrigerant in the refrigeration cycle, from the refrigerant circuit, a part of which is constituted of the scroll compressor 100, in the air conditioning apparatus, through the injection pipe 15.

(2-2) Compression Mechanism

The compression mechanism 20 mainly includes the fixed scroll 21, and a movable scroll 22 that is combined with the fixed scroll 21 to define the compression chamber Sc. The compression mechanism 20 is configured to discharge the refrigerant compressed in the compression chamber Sc. For example, the compression mechanism 20 is a compression mechanism having an asymmetric wrap structure. Alternatively, the compression mechanism 20 may be a compression mechanism having a symmetric wrap structure.

(2-2-1) Fixed Scroll

With reference to FIG. 1, the fixed scroll 21 is mounted on the housing 40. The fixed scroll 21 is fastened to the housing 40 with fixing means such as bolts (not illustrated).

As illustrated in FIG. 1, the fixed scroll 21 includes a fixed-side end plate 21*a* having an approximately disk shape, a fixed-side wrap 21*b* having a spiral shape and extending from a front face, that is, a lower face, of the fixed-side end plate 21*a* toward the movable scroll 22, and a peripheral portion 21*c* surrounding the fixed-side wrap 21*b*.

The fixed-side wrap 21*b* is a wall-shaped member protruding downward, that is, protruding toward the movable scroll 22, from the lower face of the fixed-side end plate 21*a*. When the fixed scroll 21 is seen from below, the fixed-side wrap 21*b* is formed in a spiral shape (an involute shape) extending from a region near a center of the fixed-side end plate 21*a* toward an outer periphery of the fixed-side end plate 21*a*.

The fixed-side wrap 21*b* is combined with a movable-side wrap 22*b* of the movable scroll 22 (to be described later) to define the compression chamber Sc. With reference to FIG. 1, the fixed scroll 21 and the movable scroll 22 are combined with each other so that the front face, that is, the lower face, of the fixed-side end plate 21*a* opposes to a front face, that is, an upper face, of a movable-side end plate 22*a* of the movable scroll 22 (to be described later). Thereby, the compression chamber Sc surrounded with the fixed-side end plate 21*a*, the fixed-side wrap 21*b*, the movable-side wrap 22*b*, and the movable-side end plate 22*a* is defined. In a normal operating state, when the movable scroll 22 revolves relative to the fixed scroll 21 as will be described later, the refrigerant (the low-pressure refrigerant in the refrigeration cycle), which flows from the first space S1 into a compression chamber Sc close to a peripheral side of the compression mechanism 20, is compressed and the pressure of the refrigerant rises as moving toward a compression chamber Sc close to a center of the compression mechanism 20.

With reference to FIG. 1, the fixed-side end plate 21*a* has at its approximately center a discharge port 21*d* through which the refrigerant compressed by the compression mechanism 20 is discharged. The discharge port 21*d* is formed so as to penetrate the fixed-side end plate 21*a* in the vertical direction (a thickness direction of the fixed-side end plate 21*a*). The discharge port 21*d* communicates with the compression chamber Sc close to the center of the compression mechanism 20, that is, the innermost compression chamber Sc. A discharge valve 23 is disposed above the fixed-side end plate 21*a* and configured to open and close the discharge port 21*d*. When the pressure in the innermost compression chamber Sc, with which the discharge port 21*d* communicates, is higher than the pressure in the space (the second space S2) above the discharge valve 23 by a predetermined value, the discharge valve 23 opens and allows the refrigerant to flow into the second space S2 through the discharge port 21*d*.

With reference to FIG. 1, the fixed-side end plate 21*a* also has relief holes 21*e* located closer to the outer periphery of the fixed-side end plate 21*a* than the discharge port 21*d*. The relief holes 21*e* are formed so as to penetrate the fixed-side end plate 21*a* in the thickness direction of the fixed-side end plate 21*a*. The relief holes 21*e* communicate with a compression chamber Sc closer to the outer periphery than the innermost compression chamber Sc, with which the discharge port 21*d* communicates. The relief holes 21*e* communicate with the compression chamber Sc being in the midstream of compression in the compression mechanism 20. The fixed-side end plate 21*a* has a plurality of the relief holes 21*e*; however, the number of relief holes 21*e* is not limited. The relief valves 24 are disposed above the fixed-side end plate 21*a* and configured to open and close the relief holes 21*e*. When the pressure in the compression chamber Sc, with which the relief hole 21*e* communicates, is higher than the pressure in the space (the second space S2) above the relief valve 24 by a predetermined value, the relief valve 24 opens and allows the refrigerant to flow into the second space S2 through the relief hole 21*e*.

The peripheral portion 21*c* has a thick cylindrical shape. With reference to FIG. 1, the peripheral portion 21*c* is disposed on the outer periphery of the fixed-side end plate 21*a* so as to surround the fixed-side wrap 21*b*.

(2-2-2) Movable Scroll

As illustrated in FIG. 1, the movable scroll 22 mainly includes the movable-side end plate 22*a* having an approximately disk shape, the movable-side wrap 22*b* having a spiral shape and extending from the front face, that is, the upper face, of the movable-side end plate 22*a* toward the fixed scroll 21, and a boss portion 22*c* having a cylindrical shape and protruding from a rear face, that is, a lower face, of the movable-side end plate 22*a*.

The movable-side wrap 22*b* is a wall-shaped member protruding upward, that is, protruding toward the fixed scroll 21 from the upper face of the movable-side end plate 22*a*. When the movable scroll 22 is seen from above, the movable-side wrap 22*b* is formed in a spiral shape (an involute shape) extending from a region near a center of the movable-side end plate 22*a* toward an outer periphery of the movable-side end plate 22*a*.

The movable-side end plate 22*a* is disposed above the floating member 30.

During the operation of the scroll compressor 100, the floating member 30 is pushed toward the movable scroll 22 by a pressure in a back pressure space B (see FIG. 4) defined below the floating member 30. Then, a pressing portion 34 on an upper side of the floating member 30 (to be described later) comes into contact with the rear face, that is, the lower face, of the movable-side end plate 22*a*, so that the floating member 30 presses the movable scroll 22 against the fixed scroll 21. The force of the floating member 30 to press the movable scroll 22 against the fixed scroll 21 brings the movable scroll 22 into close contact with the fixed scroll 21, and therefore reduces a refrigerant leakage from a clearance between a tooth tip of the fixed-side wrap 21*b* and the movable-side end plate 22*a* and a clearance between a tooth tip of the movable-side wrap 22*b* and the fixed-side end plate 21*a*.

Figure 4:
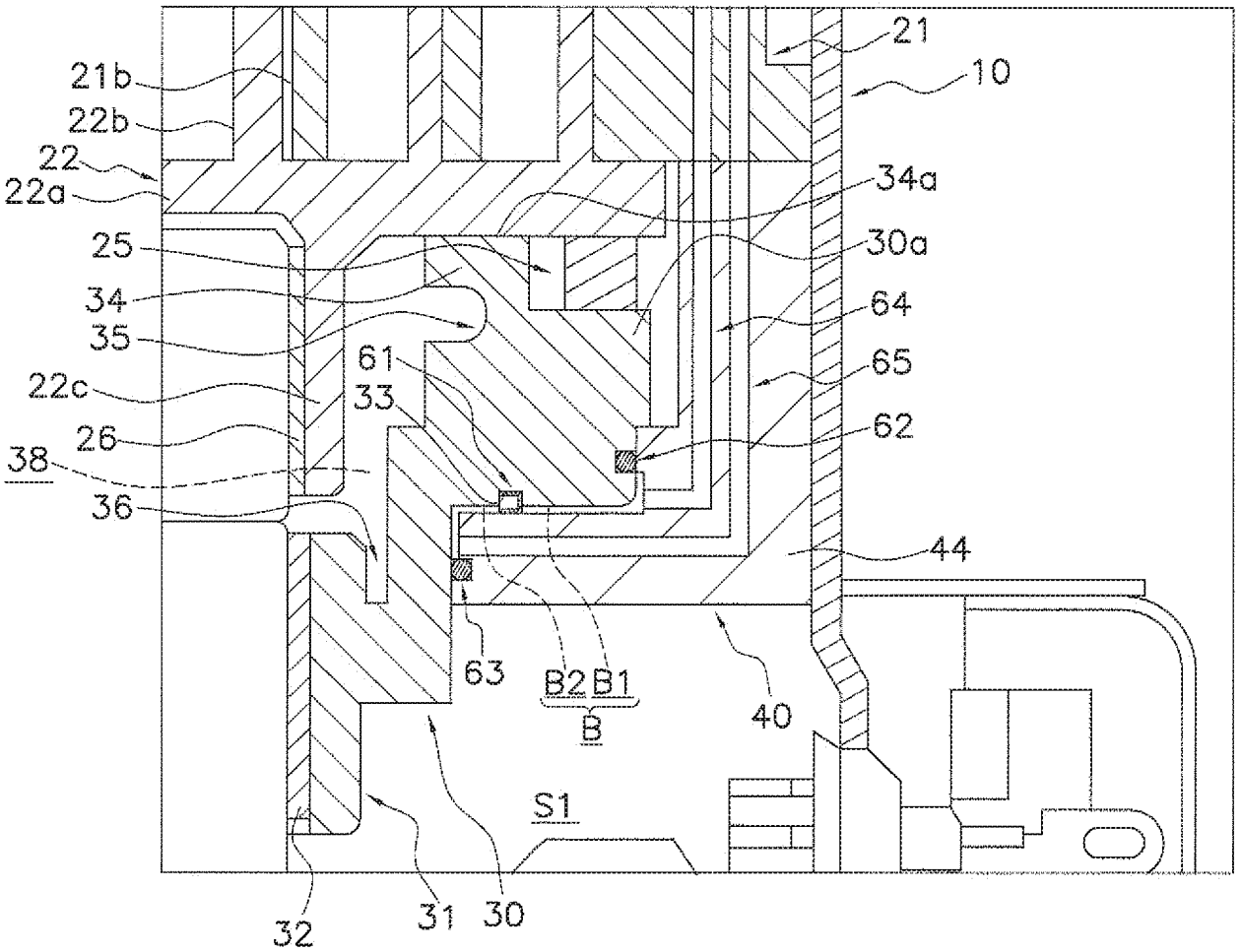
FIG. 4 is an enlarged view of the floating member and its vicinity in the scroll compressor illustrated in FIG. 1.

The back pressure space B is a space defined between the floating member 30 and the housing 40. With reference to FIG. 4, the back pressure space B is a space mainly defined on the rear face of the floating member 30, that is, below the floating member 30. The refrigerant in the compression chamber Sc of the compression mechanism 20 is guided to the back pressure space B. With reference to FIG. 4, the back pressure space B is a space sealed from the first space S1 around the back pressure space B. During the operation of the scroll compressor 100, the pressure in the back pressure space B is normally higher than the pressure in the first space S1.

With reference to FIG. 1, the compression mechanism 20 also includes an Oldham's coupling 25 disposed between the movable scroll 22 and the floating member 30. The Oldham's coupling 25 functions as a mechanism of preventing rotation of the movable scroll 22. The Oldham's coupling 25 slidably engages with both the movable scroll 22 and the floating member 30, restricts the rotation of the movable scroll 22, and causes the movable scroll 22 to revolve relative to the fixed scroll 21.

The boss portion 22*c* is a cylindrical portion whose upper end is closed with the movable-side end plate 22*a*. With reference to FIG. 1, the boss portion 22*c* is disposed in an eccentric portion space 38 surrounded with an inner face of the floating member 30. With reference to FIG. 1, a bearing metal 26 is disposed in a hollow of the boss portion 22*c*. The bearing metal 26 is fixed by press fitting in the hollow of the boss portion 22*c* however, a method of mounting the bearing metal 26 is not limited. The drive shaft 80 includes an eccentric portion 81 inserted into the bearing metal 26. The eccentric portion 81 is inserted into the bearing metal 26, so that the movable scroll 22 is connected to the drive shaft 80.

(2-3) Floating Member

With reference to FIG. 1, the floating member 30 is disposed on a rear face of the movable scroll 22. In other words, the floating member 30 is disposed opposite the fixed scroll 21 across the movable scroll 22. The floating member 30 is pushed toward the movable scroll 22 by the pressure in the back pressure space B to press the movable scroll 22 against the fixed scroll 21. The floating member 30 partly functions as a bearing pivotally supporting the drive shaft 80.

Figure 2:
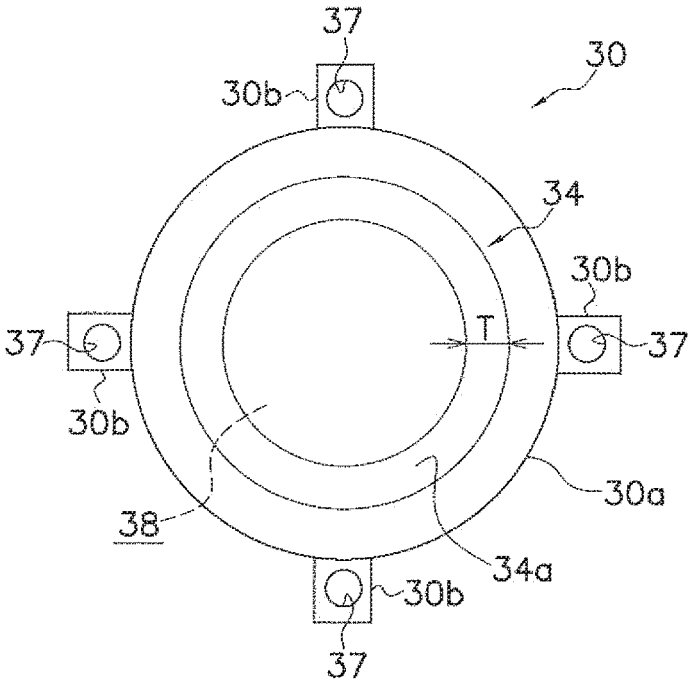
FIG. 2 is a schematic plan view of a floating member in the scroll compressor illustrated in FIG. 1.
Figure 5:
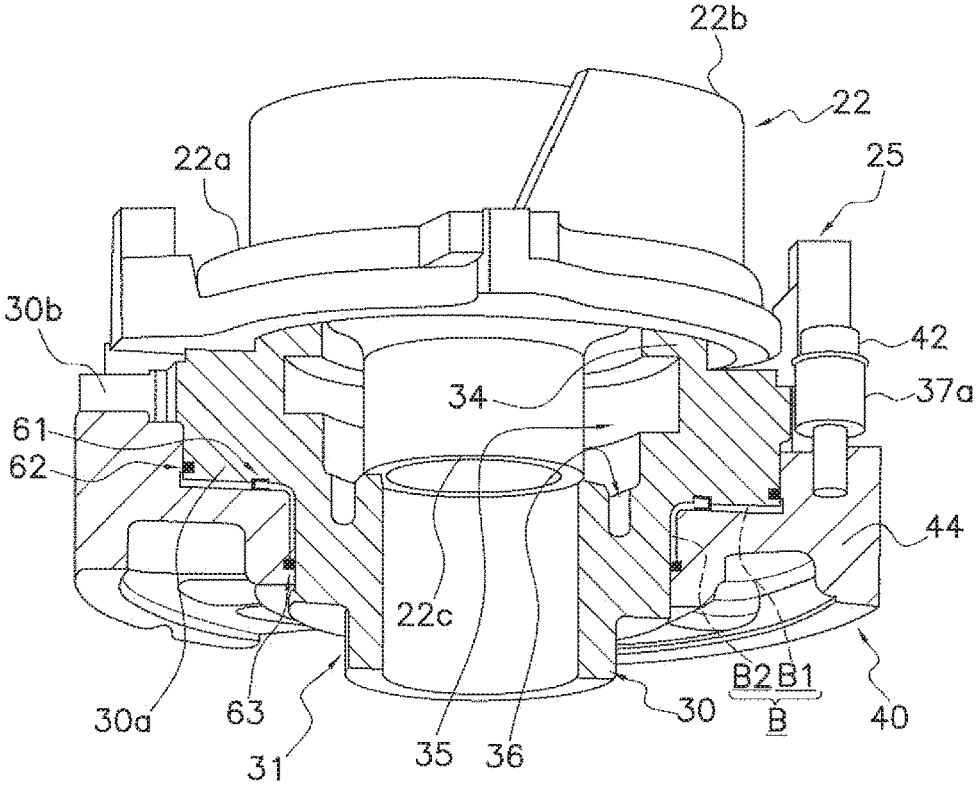
FIG. 5 is a perspective view of a movable scroll, the floating member, and a housing as well as their vicinities in the scroll compressor illustrated in FIG. 1, provided that the floating member and the housing are depicted in their cross sections.

With reference to FIGS. 1, 2, and 5, the floating member 30 mainly includes a cylindrical portion 30*a*, the pressing portion 34, a protrusion portion 30*b*, and an upper bearing housing 31.

The cylindrical portion 30*a* has an approximately cylindrical shape. With reference to FIG. 1, the eccentric portion space 38 is defined in a hollow of the cylindrical portion 30*a* and is surrounded with an inner face of the cylindrical portion 30*a*. With reference to FIG. 1, the boss portion 22*c* of the movable scroll 22 is disposed in the eccentric portion space 38.

The pressing portion 34 has an approximately cylindrical shape. The pressing portion 34 extends from the cylindrical portion 30*a* toward the movable scroll 22. The pressing portion 34 has on its upper end a thrust surface 34*a* (see FIG. 4) opposed to the rear face of the movable-side end plate 22*a* of the movable scroll 22. As illustrated in FIG. 2, the thrust surface 34*a* has a ring shape as seen in plan view. When the floating member 30 is pushed toward the movable scroll 22 by the pressure in the back pressure space B, the thrust surface 34*a* comes into contact with the rear face of the movable-side end plate 22*a*, and presses the movable scroll 22 against the fixed scroll 21.

During the operation of the scroll compressor 100, force acting on the movable scroll 22 occasionally inclines the movable-side end plate 22*a* with respect to a horizontal plane. In such a case, preferably, the thrust surface 34*a* inclines while following the inclination of the movable-side end plate 22*a* in order to reduce partial contact of the thrust surface 34*a* with the movable-side end plate 22*a*. For this reason, with reference to FIG. 4, the pressing portion 34 has in its all-around inner face an elastic groove 35. The elastic groove 35 is formed in a root of the pressing portion 34. In other words, the elastic groove 35 is formed near a joint between the pressing portion 34 and the cylindrical portion 30*a*.

Figure 3:
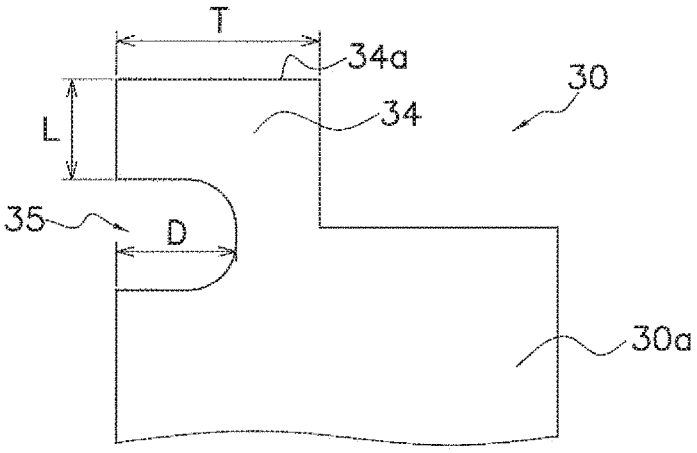
FIG. 3 is a diagram of preferred dimensional design around a thrust portion of the floating member in the scroll compressor illustrated in FIG. 1.

In forming the elastic groove 35, preferably, a relation expressed by Formula (1) is established among a thickness T of the thrust surface 34*a* in a radial direction of the pressing portion 34 (see FIG. 3), a length L from the thrust surface 34*a* to the elastic groove 35 in an axial direction of the drive shaft 80, that is, a vertical direction (see FIG. 3), and a depth D of the elastic groove 35 in the radial direction of the pressing portion 34 (see FIG. 3). The establishment of the relation expressed by Formula (1) particularly allows the thrust surface 34*a* to follow the inclination of the movable-side end plate 22*a* with ease.

$$(D/T)^2/(L/T)^3 \leq 0.6 \quad (1)$$

With reference to FIG. 2, the protrusion portion 30*b* has a flat plate shape and extends radially outward from an outer peripheral edge of the cylindrical portion 30*a*. The floating member 30 includes a plurality of the protrusion portions 30*b*. With reference to FIG. 2, each of the protrusion portions 30*b* has a through-hole 37 penetrating the protrusion portions 30*b* in the axial direction of the drive shaft 80, that is, the vertical direction. With reference to FIG. 1, a bush 37*a* is disposed in each of the through-holes 37. The bush 37*a* is an example of a supported portion. The bushes 37*a* are circumferentially arranged when the floating member 30 is seen in the axial direction of the drive shaft 80, that is, as seen in plan view. The bushes 37*a* of the floating member 30 are supported by a supporting portion 41 of the housing 40 such that the floating member 30 is slidable in the axial direction of the drive shaft 80.

With reference to FIGS. 1 and 5, the supporting portion 41 includes bolts 42. The bolts 42 are respectively inserted into the bushes 37*a*. The bolts 42 are respectively screwed into screw holes 44*a* in a housing body 44 of the housing 40 (to be described later) so that the bolts 42 are secured to the housing body 44. When the floating member 30 receives force that causes the floating member 30 to move toward the movable scroll 22 or receives force that causes the floating member 30 to move away from the movable scroll 22, each bush 37*a* slides relative to the corresponding bolt 42 which is inserted into that bush 37*a*. Consequently, the floating member 30 moves in the axial direction of the drive shaft 80. It should be noted that the direction of the force acting on the floating member 30 is determined based on a balance of, for example, force of the pressure in the back pressure space B to push the floating member 30, force of the pressure in the compression chamber Sc to press the movable scroll 22 against the floating member 30, and gravity on each of the movable scroll 22 and the floating member 30.

In the first embodiment, the floating member 30 includes four protrusion portions 30*b* disposed at equal angular intervals around the center of the floating member 30. However, the number of protrusion portions 30*b* is not limited to four. The number of protrusion portions 30*b* may be appropriately determined. Preferably, the floating member 30 includes three or more protrusion portions 30*b* from the viewpoint of reducing inclination of the floating member 30.

The upper bearing housing 31 is disposed below the cylindrical portion 30*a*, that is, below the eccentric portion space 38. With reference to FIG. 1, the upper bearing housing 31 has an approximately cylindrical shape. The floating member 30 also includes a bearing metal 32 disposed in the upper bearing housing 31. The bearing metal 32 is an example of a bearing. The bearing metal 32 is fixed by press fitting in a hollow of the upper bearing housing 31; however, a method of mounting the bearing metal 32 is not limited. The drive shaft 80 includes a main shaft 82 inserted into the bearing metal 32. The bearing metal 32 in the upper bearing housing 31 pivotally supports the main shaft 82 of the drive shaft 80.

In order to reduce partial contact of the bearing metal 32 with the main shaft 82 even when the main shaft 82 of the drive shaft 80 inclines due to an influence of, for example, force acting on the movable scroll 22, preferably, the upper bearing housing 31 inclines while following the inclination of the main shaft 82. For this reason, with reference to FIG. 4, the floating member 30 has an elastic groove 36 having an annular shape. The elastic groove 36 is formed at a joint between the cylindrical portion 30*a* and the upper bearing housing 31 so as to surround the upper bearing housing 31.

The floating member 30 is configured to press the movable scroll 22 against the fixed scroll 21. In addition, the floating member 30 includes the upper bearing housing 31 serving as the bearing of the drive shaft 80. The floating member 30 thus produces the following advantageous effect.

When the floating member 30 receives force from the movable scroll 22, this force generates a moment on the floating member 30 at a position around each bush 37*a* supporting the floating member 30. With regard to this moment, the upper bearing housing 31 of the floating member 30 cancels out the moment around each bush 37*a* being generated from the force from the movable scroll 22, with a moment around each bush 37*a* being generated from force received by the upper hearing housing 31.

With reference to FIG. 1, in order to attain such an advantageous effect with ease, preferably, a ratio (A2/A1) of a distance A1 from a center of each bush 37*a* to a center of the movable-side wrap 22*b* in the axial direction of the drive shaft 80 to a distance A2 from a center of the bearing metal 32 to the center of each bush 37*a* in the axial direction of the drive shaft 80 falls within a range from 0.5 or more to 1.5 or less. More preferably, the ratio (A2/A1) of the distance A1 from the center of each bush 37*a* to the center of the movable-side wrap 22*b* in the axial direction of the drive shaft 80 to the distance A2 front the center of the bearing metal 32 to the center of each bush 37*a* in the axial direction of the drive shaft 80 falls within a range from 0.7 or more to 1.3 or less.

However, the configuration of the floating member 30 is merely illustrative. Alternatively, the floating member 30 may have only the function of pressing the movable scroll 22 against the fixed scroll 21. For example, the housing 40 rather than the floating member 30 may have a function of the bearing of the drive shaft 80.

(2-4) Housing

With reference to FIG. 1, the housing 40 is disposed below the fixed scroll 21. The fixed scroll 21 is fastened to the housing 40, for example, with bolts (not illustrated). With reference to FIG. 1, the housing 40 is disposed below the floating member 30. The housing 40 supports the floating member 30. With reference to FIGS. 4 and 5, the back pressure space B is defined between the housing 40 and the floating member 30.

With reference to FIG. 1, the housing 40 includes the housing body 44 and the supporting portion 41.

The housing body 44 has an approximately cylindrical shape. The housing body 44 is mounted to the inner face of the casing 10. The housing body 44 is fixed by press fitting to the inner face of the casing 10; however, a method of mounting the housing body 44 is not limited.

The supporting portion 41 supports the bushes 37*a* disposed on the floating member 30, that is, disposed in the through-holes 37 of the protrusion portions 30*b*, such that the floating member 30 is slidable in the axial direction of the drive shaft 80, that is, the vertical direction. With reference to FIGS. 1 and 5, the supporting portion 41 includes the bolts 42. The bolts 42 are respectively inserted into the bushes 37*a*. The bolts 42 are respectively screwed into the screw holes 44*a* in the housing body 44 so that the bolts 42 are secured to the housing body 44. When the floating member 30 receives force that causes the floating member 30 to move toward the movable scroll 22 or receives force that causes the floating member 30 to move away from the movable scroll 22, each bush 37*a* of the floating member 30 slides relative to the corresponding bolt 42. Consequently, the floating member 30 moves in the axial direction of the drive shaft 80.

(2-5) Seal Member

The seal member 60 (see FIG. 1) defines the back pressure space B between the floating member 30 and the housing 40. With referent to FIG. 4, the seal member 60 partitions the back pressure space B into a first chamber B1 and a second chamber B2. In the first embodiment, each of the first chamber B1 and the second chamber B2 has an approximately annular ring shape as seen in plan view. The second chamber B2 is located inward with respect to the first chamber B1. The first chamber B1 is larger in area than the second chamber B2 as seen in plan view.

The first chamber B1 communicates with the compression chamber Sc being in the midstream of compression, via a first flow path 64. The first flow path 64 is a refrigerant flow path for guiding into the first chamber B1 the refrigerant being in the midstream of compression in the compression mechanism 20. The first flow path 64 extends over the fixed scroll 21 and the housing 40. The second chamber B2 communicates with the discharge port 21*d* of the fixed scroll 21 via a second flow path 65. The second flow path 65 is a refrigerant flow path for guiding into the second chamber B2 the refrigerant discharged from the compression mechanism 20. The second flow path 65 extends over the fixed scroll 21 and the housing 40.

With this configuration, the pressure in the second chamber B2 is normally higher than the pressure in the first chamber B1 during the operation of the scroll compressor 100. Since the first chamber B1 is larger in area than the second chamber B2 as seen in plan view, the force of the pressure in the back pressure space B to press the movable scroll 22 against the fixed scroll 21 is less prone to become excessively large. The pressure in the compression chamber Sc becomes normally higher at the inner side than at the outer side. Therefore, force of the pressure in the compression chamber Sc to push the movable scroll 22 downward and force of the floating member 30 to push the movable scroll 22 upward are balanced with ease when arranging the second chamber B2, in which the pressure is nominally higher, inside with respect to the first chamber B1.

With referent to FIG. 1, the seal member 60 includes a first seal member 61, a second seal member 62, and a third seal member 63.

Each of the second seal member 62 and the third seal member 63 is, but not limited to, an O-ring. The O-ring is an annular gasket having a circular cross section. Each of the second seal member 62 and the third seal member 63 is made of, for example, synthetic resin. The material for each of the second seal member 62 and the third seal member 63 may be appropriately determined in accordance with an operating temperature, a kind of a refrigerating machine oil or a refrigerant with which the second seal member 62 and the third seal member 63 are in contact, and other conditions.

With referent to FIG. 4, the second seal member 62 is disposed in an annular groove thrilled in an outer side face of the cylindrical portion 30*a* of the floating member 30. The outer side face, in which the annular groove is formed, of the cylindrical portion 30*a* is opposed to an inner side face of the housing body 44 of the housing 40. With referent to FIG. 4, the third seal member 63 is disposed in an annular groove formed in the inner side face of the housing body 44. The inner side face, in which the annular groove is formed, of the housing body 44 is opposed to the joint between the cylindrical portion 30*a* and the upper bearing housing 31 in the floating member 30. In the first embodiment, the second seal member 62 is disposed in the annular groove formed in the floating member 30. Alternatively, the second seal member 62 may be disposed in the annular groove formed in the housing 40. Also in the first embodiment, the third seal member 63 is disposed in the annular groove formed in the housing 40. Alternatively, the third seal member 63 may be disposed in the annular groove formed in the floating member 30.

With referent to FIG. 4, the second seal member 62 and the third seal member 63 define the back pressure space B between the floating member 30 and the housing 40. In other words, the second seal member 62 and the third seal member 63 hermetically seal between the back pressure space B and the first space S1. The second seal member 62 particularly seals between the first chamber B1 in the back pressure space B and the first space S1. The third seal member 63 particularly seals between the second chamber B2 in the back pressure space B and the first space S1.

The first seal member 61 partitions the back pressure space B into the first chamber B1 and the second chamber B2. With reference to FIG. 4, the first chamber B1 and the second chamber B2 adjoin each other with the first seal member 61 interposed therebetween.

With reference to FIG. 4, the first seal member 61 is accommodated in an accommodation groove 33 formed in a surface of the floating member 30. This surface is orthogonal to a direction in which the floating member 30 moves. In other words, this surface is orthogonal to the axial direction of the drive shaft 80, that is, the vertical direction. The accommodation groove 33 is formed in a bottom face of the cylindrical portion 30*a* of the floating member 30. The bottom face of the cylindrical portion 30*a* of the floating member 30 is opposed to an upper face of the housing body 44 of the housing 40. In the first embodiment, the accommodation groove 33 is formed in the floating member 30. Alternatively, the housing body 44 of the housing 40 may have, in its surface orthogonal to the direction in which the floating member 30 moves, an accommodation groove accommodating therein the first seal member 61.

Figure 6:
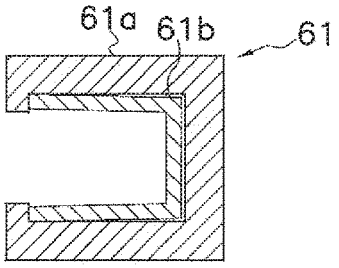
FIG. 6 is a schematic sectional view of a structure of a first seal member in the scroll compressor illustrated in FIG. 1.

With reference to FIG. 6, the first seal member 61 is an annular gasket having a U-shaped cross section.

A description will be given of a structure of the first seal member 61. With reference to FIG. 6, the first seal member 61 includes a U-shaped seal 61*a* and a leaf spring 61*b*. The U-shaped seal 61*a* is formed in an annular shape and has a U-shaped cross section. The U-shaped seal 61*a* is made of, for example, synthetic resin. The leaf spring 61*b* is made of, for example, metal. As in the U-shaped seal 61*a*, the leaf spring 61*b* has a U-shaped cross section. The leaf spring 61*b* may be thrilled in an annular shape as in the U-shaped seal 61*a*. Alternatively, the leaf spring 61*b* may be discontinuous, that is, non-annular members disposed in the U-shaped seal 61*a*. With reference to FIG. 6, the leaf spring 61*b* is disposed in the U-shaped seal 61*a* such that the leaf spring 61*b* and the U-shaped seal 61*a* are opened in the same direction. The leaf spring 61*b* presses the U-shaped seal 61*a* against the floating member 30 so as to expand the U-shaped seal 61*a*.

The first seal member 61 is a gasket that is deformable such that its U-shaped opening expands or narrows. The first seal member 61 is accommodated in the accommodation groove 33 with its opening directed sideward as described above. The dimension of the first seal member 61 therefore changes while following the movement of the floating member 30.

In a state in which the scroll compressor 100 is not operated and the inside of the casing 10 is under an approximately identical pressure as a whole, the first seal member 61 is pushed from above by the weight of the movable scroll 22 and the weight of the floating member 30. In this state, the U-shaped opening of the first seal member 61 is narrowed as compared with a case where no force acts on the first seal member 61. Also in such a state, the first seal member 61 is not crushed by the weight of the movable scroll 22 and the weight of the floating member 30, but the leaf spring 61*b* presses the U-shaped seal 61*a* against the floating member 30.

The first seal member 61 having the U-shaped cross section is accommodated in the accommodation groove 33 of the floating member 30 with its opening directed sideward. The first seal member 61 is accommodated in the accommodation groove 33 of the floating member 30 with its opening particularly directed inward. In other words, the first seal member 61 is accommodated in the accommodation groove 33 of the floating member 30 with its opening directed to the second chamber B2. The first seal member 61 functions as follows when being disposed in the accommodation groove 33 in the orientation described above.

As described above, the pressure in the inner second chamber B2 is normally higher than the pressure in the outer first chamber B1. When the pressure in the second chamber B2 is higher than the pressure in the first chamber B1, the first seal member 61 is deformed such that its opening is enlarged, thereby sealing the flow of the refrigerant from the second chamber B2 into the first chamber B1. This configuration therefore prevents both the pressure in the first chamber B1 and the pressure in the second chamber B2 from rising to a relatively high level that is equal to the pressure of the refrigerant to be discharged from the compression mechanism 20. The force of the pressure in the back pressure space B to press the movable scroll 22 against the fixed scroll 21 is thus less prone to become excessively large.

Although the pressure in the inner second chamber B2 is normally higher than the pressure in the outer first chamber B1 as described above, the pressure of the compression chamber Sc being in the midstream of compression, that is, the pressure in one of the compression chamber Sc closer to the outer periphery than the innermost compression chamber Sc is, becomes sometimes higher than the pressure in the innermost compression chamber Sc, depending on operating conditions (e.g., a case where the low pressure in the refrigeration cycle is relatively high). In such a case, the pressure in the outer first chamber B1 becomes higher than the pressure in the inner second chamber B2. When the pressure in the first chamber B1 is higher than the pressure in the second chamber B2, the first seal member 61 does not seal, because of its structure, the flow of the refrigerant from the first chamber B1 into the second chamber B2. The pressure in the compression chamber Sc being in the midstream of compression is thus released, via the first chamber B1 and the second chamber B2, to the space (the second space S2) into which the refrigerant discharged from the compression mechanism flows. This configuration therefore prevents the compression mechanism 20 from receiving excessively large pressure due to, for example, liquid compression, and also prevents the force to press the movable scroll 22 against the fixed scroll 21 from becoming excessively large due to a rise of the pressure in the back pressure space B.

(2-6) Motor

The motor 70 is configured to drive the movable scroll 22. With reference to FIG. 1, the motor 70 includes a stator 71 having an annular shape and fixed to an inner wall surface of the casing 10, and a rotor 72 rotatably accommodated inside the stator 71 with a slight gap, that is, an air gap.

The rotor 72 is a cylindrical member into which the drive shaft 80 is inserted. The rotor 72 is coupled to the movable scroll 22 via the drive shaft 80. When the rotor 72 rotates, the motor 70 drives the movable scroll 22 to cause the movable scroll 22 to revolve relative to the fixed scroll 21.

(2-7) Drive Shaft

The drive shaft 80 couples the rotor 72 of the motor 70 to the movable scroll 22 of the compression mechanism 20. The drive shaft 80 extends in the vertical direction. The drive shaft 80 transmits the driving force of the motor 70 to the movable scroll 22.

With reference to FIG. 1, the drive shaft 80 mainly includes the eccentric portion 81 and the main shaft 82.

The eccentric portion 81 is disposed on an upper end of the main shaft 82. The eccentric portion 81 has a center axis that is eccentric relative to a center axis of the main shaft 82. The eccentric portion 81 is coupled to the bearing metal 26 in the boss portion 22*c* of the movable scroll 22.

The main shaft 82 is pivotally supported by the bearing metal 32 disposed in the upper bearing housing 31 of the floating member 30 and a bearing metal 91 disposed in the lower bearing housing 90 to be described later. The main shaft 82 is inserted into and coupled to the rotor 72 of the motor 70 at a position between the upper bearing housing 31 and the lower bearing housing 90. The main shaft 82 extends in the vertical direction.

The drive shaft 80 has an oil passage (not illustrated). The oil passage includes a main passage (not illustrated) and a branch passage (not illustrated). The main passage extends from a lower end to an upper end of the drive shaft 80 in the axial direction of the drive shaft 80. The branch passage extends from the main passage in a radial direction of the drive shaft 80. The refrigerating machine oil in the oil reservoir space 11 is pumped up by a pump (not illustrated) disposed on the lower end of the drive shaft 80, and then is supplied to, for example, sliding portions between the drive shaft 80 and the bearing metals 26, 32, and 91, and a sliding portion of the compression mechanism 20, via the oil passage.

(2-8) Lower Bearing Housing

The lower bearing housing 90 (see FIG. 1) is fixed to the inner face of the casing 10. The lower bearing housing 90 (see FIG. 1) is disposed below the motor 70. The lower bearing housing 90 has a hollow having an approximately columnar shape. The bearing metal 91 is disposed in the hollow. The bearing metal 91 is fixed by press fitting in the hollow of the lower bearing housing 90; however, a method of mounting the bearing metal 91 is not limited. Into the bearing metal 91, the main shaft 82 of the drive shaft 80 is inserted. The bearing metal 91 pivotally supports a lower portion of the main shaft 82 of the drive shaft 80 such that the drive shaft 80 is rotatable.

(3) Operation of Scroll Compressor

A description will be given of the operation of the scroll compressor 100. The following description concerns the operation of the scroll compressor 100 in a normal state, that is, a state in which the pressure of the refrigerant to be discharged from the compression mechanism 20 through the discharge port 21*d* is higher than the pressure in the compression chamber Sc being in the midstream of compression.

When the motor 70 is driven, the rotor 72 rotates, and the drive shaft 80 coupled to the rotor 72 also rotates. When the drive shaft 80 rotates, the movable scroll 22 does not rotate, but revolves relative to the fixed scroll 21, by the action of the Oldham's coupling 25. Then, the low-pressure refrigerant in the refrigeration cycle, which has flown into the first space S1 through the suction pipe 13, is sucked into the compression chamber Sc close to the peripheral edge of the compression mechanism 20, via a refrigerant passage (not illustrated) in the housing 40. As the movable scroll 22 revolves, the first space S1 does not communicate with the compression chamber Sc. As the volume of the compression chamber Sc decreases by the revolution of the movable scroll 22, the pressure in the compression chamber Sc rises. In addition, the refrigerant is injected into the compression chamber Sc being in the midstream of compression, through the injection pipe 15. The pressure of the refrigerant rises as the refrigerant moves from the compression chamber Se close to the peripheral edge, that is, the outer compression chamber Sc, to the compression chamber Sc close to the center, that is, the inner compression chamber Sc. The high-pressure refrigerant in the refrigeration cycle is finally obtained. The refrigerant compressed by the compression mechanism 20 is discharged from the compression mechanism 20 to the second space S2 through the discharge port 21*d* located near the center of the fixed-side end plate 21*a*. The high-pressure refrigerant in the refrigeration cycle is discharged from the second space S2 through the discharge pipe 14.

(4) Features (4-1)

According to the first embodiment, the scroll compressor 100 includes the compression mechanism 20, the motor 70, the drive shaft 80, the floating member 30, and the housing 40. The compression mechanism 20 includes the fixed scroll 21 and the movable scroll 22. The fixed scroll 21 includes the fixed-side wrap 21*b* having a spiral shape. The movable scroll 22 includes the movable-side wrap 22*b* having a spiral shape. The movable-side wrap 22*b* is combined with the fixed-side wrap 21*b* to define the compression chamber Sc. The compression mechanism 20 is configured to discharge a refrigerant compressed in the compression chamber Sc. The motor 70 is configured to drive the movable scroll 22 to cause the movable scroll 22 to revolve relative to the fixed scroll 21. The drive shaft 80 couples the movable scroll 22 to the motor 70. The floating member 30 is pushed toward the movable scroll 22 by a pressure in a back pressure space B to press the movable scroll 22 against the fixed scroll 21. The housing 40 supports the floating member 30. The back pressure space B is defined between the housing 40 and the floating member 30. The floating member 30 includes a plurality of supported portions (bushes 37*a*) arranged circumferentially. The housing 40 includes a supporting portion 41. The supporting portion 41 supports the supported portions (the bushes 37*a*) of the floating member 30 such that the floating member 30 is slidable in an axial direction of the drive shaft 80.

According to the first embodiment, in the scroll compressor 100, the floating member 30 is not supported at its outer peripheral side face by the housing 40 at its inner peripheral side face, but the plurality of supported portions (the bushes 37*a*) of the floating member 30 are supported by the corresponding supporting portion 41 of the housing 40. Ensuring accuracy, such as processing accuracy and mounting accuracy, for the supported portions (the bushes 37*a*) and the supporting portion 41 is relatively easier than ensuring accuracy for the entire outer periphery of the floating member 30. The scroll compressor 100 is therefore capable of reducing inclination of the floating member 30 and is also capable of reducing the number of man-hours for assembly and manufacture.

(4-2)

According to the first embodiment, in the scroll compressor 100, each of the supported portions is a bush 37*a* disposed on the floating member 30. The supporting portion 41 includes bolts 42 respectively inserted into the bushes 37*a*.

According to the first embodiment, in the scroll compressor 100, the bolts 42 of the supporting portion 41 are respectively inserted into the bushes 37*a* serving as the supported portions with ease even when an axis of each bush 37*a* is not aligned with an axis of the corresponding bolt 42. This configuration therefore improves ease of assembly of the scroll compressor 100.

(4-3)

According to the first embodiment, in the scroll compressor 100, the floating member 30 farther includes the bearing metal 32 (a bearing) pivotally supporting the drive shaft 80. The ratio (A1/A2) of the distance A1 from the center of each bush 37*a* to the center of the movable-side wrap 22*b* in the axial direction of the drive shaft 80 to the distance A2 from the center of the bearing metal 32 to the center of each bush

37*a* in the axial direction of the drive shaft 80 falls within a range from 0.5 or more to 1.5 or less.

According to the first embodiment, the scroll compressor 100 cancels out the rotation moment around each hush 37*a* to reduce inclination of the floating member 30 relative to the movable scroll 22. The scroll compressor 100 therefore operates with good efficiency by reducing the refrigerant leakage from the clearance between the distal end of the wrap and the end plate in the scroll.

(4-4)

According to the first embodiment, in the scroll compressor 100, the floating member 30 includes the pressing portion 34 having a cylindrical shape. The pressing portion 34 extends toward the movable scroll 22. The pressing portion 34 has on its end the thrust surface 34*a* to be brought into contact with the movable scroll 22. The pressing portion 34 has in its all-around inner face the elastic groove 35. In the scroll compressor 100, a relation of $(D/T)^2/(L/T)^3 \leq 0.6$, where T represents the thickness of the thrust surface 34*a* in the radial direction of the pressing portion 34, L represents the length from the thrust surface 34*a* to the elastic groove 35 in the axial direction of the drive shaft 80, and D represents the depth of the elastic groove 35 in the radial direction of the pressing portion 34, is satisfied.

According to the first embodiment, in the scroll compressor 100, the thrust surface 34*a* of the floating member 30 inclines while following inclination of the movable scroll 22. This configuration thus reduces occurrence of partial contact of the movable scroll 22 with the thrust surface 34*a* of the floating member 30.

(5) Modifications

The following description concerns modifications of the first embodiment. It should be noted that the following modifications may be appropriately combined insofar as there are no inconsistencies.

(5-1) Modification A

According to the first embodiment, the scroll compressor 100 is a so-called low pressure dome-type scroll compressor including a high-pressure space, that is, the second space S2 into which the refrigerant discharged from the compression mechanism 20 flows, and a low-pressure space, that is, the first space S1 in which the motor 70 for driving the compression mechanism 20 is disposed. However, a scroll compressor according to the present invention is not limited to a low pressure dome-type scroll compressor. The structure of the scroll compressor 100, in which the floating member 30 is slidably supported by the supporting portion 41, described in the first embodiment, is applicable to a so-called high pressure dome-type scroll compressor.

(5-2) Modification B

According to the first embodiment, in the scroll compressor 100, the first chamber B1 is located outward with respect to the second chamber B2. However, a scroll compressor according to the present invention is not limited to this structure. For example, the second chamber B2 may be located outward with respect to the first chamber B1. It is however preferable that the second chamber B2 be located inward with respect to the first chamber B1 from the viewpoint of pressing the movable scroll 22 against the fixed scroll 21 with appropriate force.

(5-3) Modification C

According to the first embodiment, in the scroll compressor 100, the first chamber B1 is larger in area than the second chamber B2 as seen in plan view. However, a scroll compressor according to the present invention is not limited to this structure. For example, the second chamber B2 may be larger in area than the first chamber B1 as seen in plan view. It is however preferable that the first chamber B1 be larger in area than the second chamber B2 from the viewpoint of preventing force to press the movable scroll 22 against the fixed scroll 21 from becoming excessively large.

(5-4) Modification D

According to the first embodiment, in the scroll compressor 100, the back pressure space B is partitioned into the first chamber B1 and the second chamber B2. However, a scroll compressor according to the present invention is not limited to this structure. For example, the back pressure space B may be a space which is not partitioned and into which the refrigerant being in the midstream of compression by the compression mechanism 20 is guided, or a space which is not partitioned and into which the refrigerant discharged from the compression mechanism 20 is guided.

(5-5) Modification E

According to the first embodiment, the scroll compressor 100 is a vertical scroll compressor in which the drive shaft 80 extends vertically. However, a scroll compressor according to the present invention is not limited to this structure. The present invention is also applicable to a horizontal scroll compressor in which a drive shaft extends horizontally.

(5-6) Modification F

According to the first embodiment, the supporting portion 41 including the bolts 42 in the housing 40 supports the bushes 37*a*, disposed in the floating member 30 and serving as the supported portions, such that the floating member 30 is slidable in the axial direction of the drive shaft 80. However, the supported portions and the supporting portion are not limited to this configuration.

Figure 7:
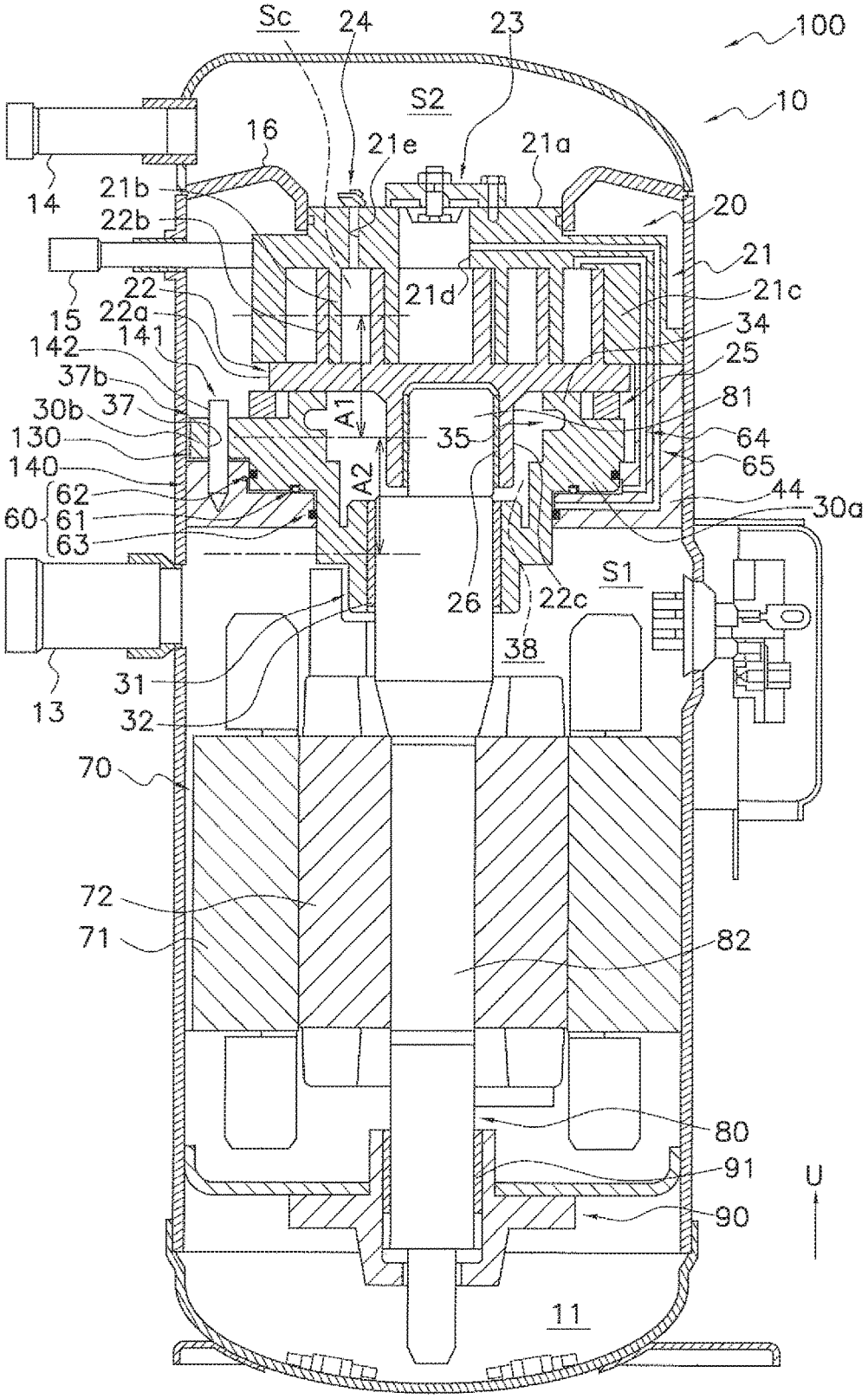
FIG. 7 is a schematic longitudinal sectional view of a scroll compressor according to Modification F of the present invention.

As illustrated in FIG. 7, for example, the supported portions may be a plurality of rings 37*b* disposed on a floating member 130. For example, the rings 37*b* correspond to the protrusion portions 30*b* with the through-holes 37. In addition, as illustrated in FIG. 7, for example, a supporting portion 141 of a housing 140 may include a plurality of control pins 142 which are inserted into the rings 37*b* (e.g., the through-holes 37 in the protrusion portions 30*b*). The supporting portion 141 including the control pins 142 in the housing 140 may support the rings 37*b* of the floating member 130 serving as the supported portions such that the floating member 130 is slidable in the axial direction of the drive shaft 80. With reference to FIG. 7, in this configuration, preferably, a ratio (A2/A1) of a distance A2 from a center of each ring 37*b*, that is, a center of each through-hole 37 to the center of the movable-side wrap 22*b* in the axial direction of the drive shaft 80 to a distance A1 from the center of the bearing metal 32 to the center of each ring 37*b* in the axial direction of the drive shaft 80 falls within a range from 0.5 or more to 1.5 or less. More preferably, the ratio (A2/A1) falls within a range from 0.7 or more to 1.3 or less.

Figure 8:
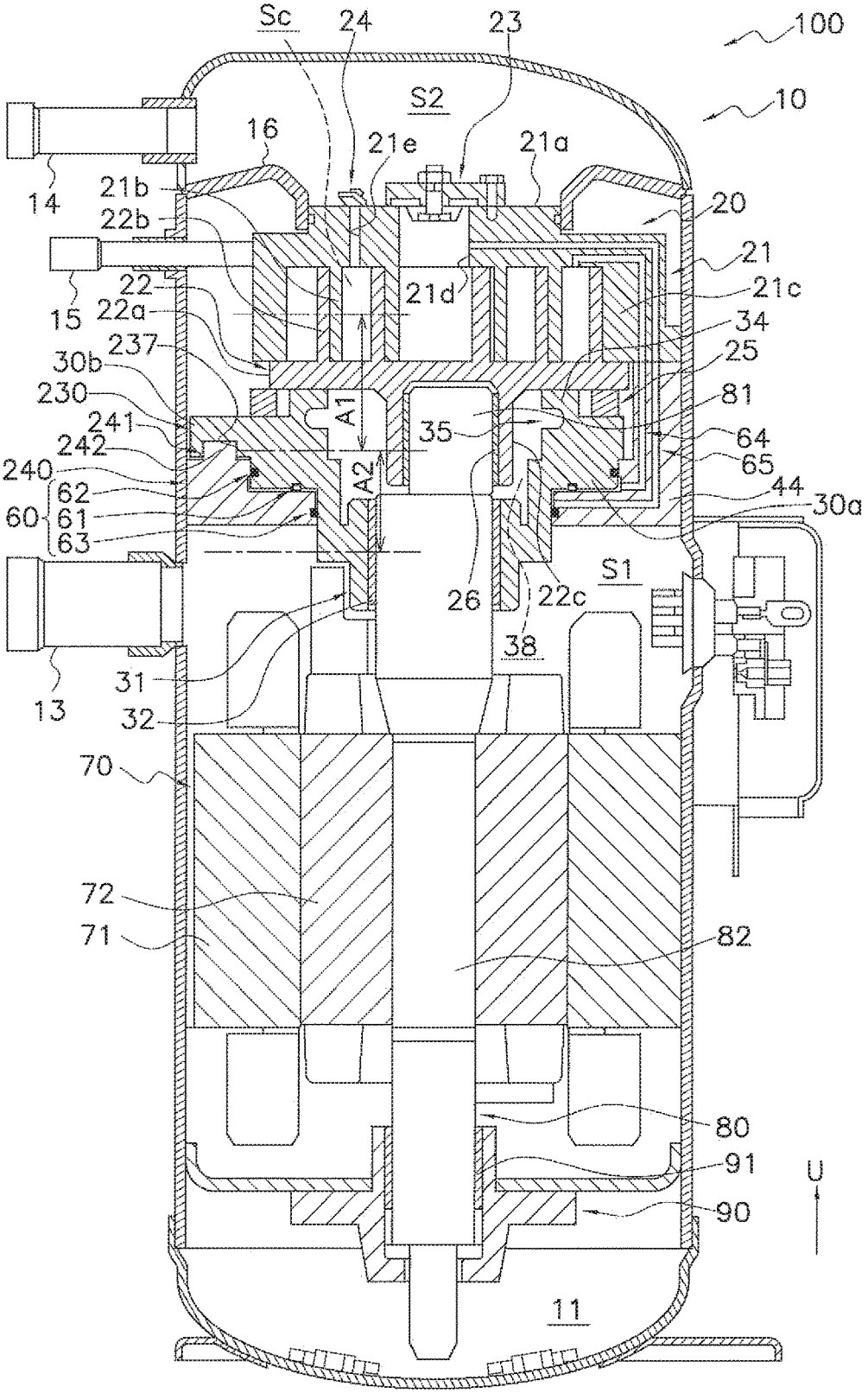
FIG. 8 is a schematic longitudinal sectional view of another scroll compressor according to Modification F of the present invention.
Figure 9:
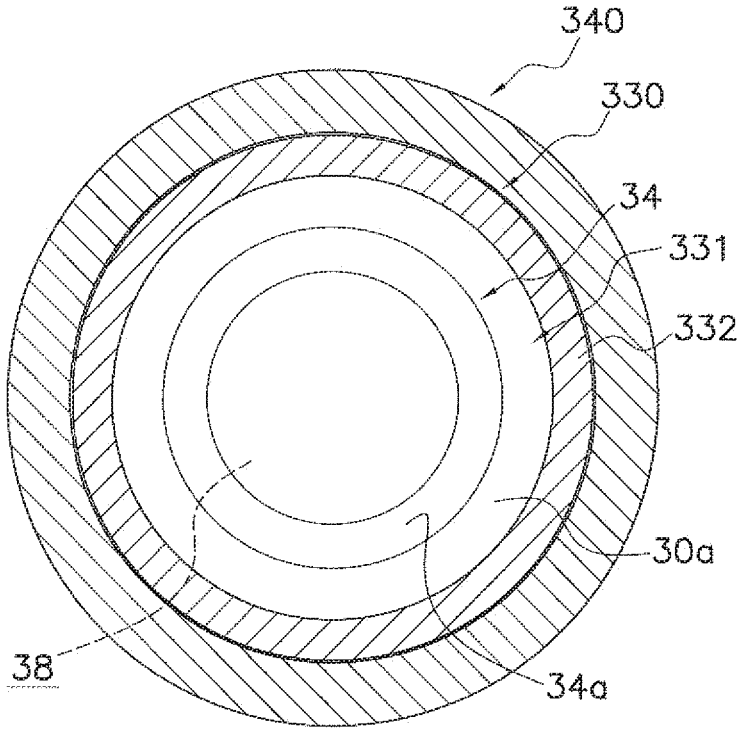
FIG. 9 is a schematic plan view of a floating member and a housing in a scroll compressor according to a second embodiment of the present invention.

As illustrated in FIG. 8, for example, the supported portions may alternatively be recesses 237 in protrusion portions 30*h* of a floating member 230. In addition, as illustrated in FIG. 8, for example, a supporting portion 241 of a housing 240 may include a plurality of protrusions 242 fated to the recesses 237. The protrusions 242 are disposed on a main body 244 of the housing 240 and protrude upward. The protrusions 242 of the housing 240 may support the recesses 237 of the floating member 230 serving as the supported portions such that the floating member 230 is slidable in the axial direction of the drive shaft 80. In this configuration, preferably, a ratio (A2/A1) of a distance A1 from a center of each recess 237 to the center of the movable-side wrap 22*b* in the axial direction of the drive shaft 80 to a distance A2 from the center of the bearing metal 32 to the center of each recess 237 in the axial direction of the drive shaft 80 falls within a range from 0.5 or more to 1.5 or less. More preferably, the ratio (A2/A1) falls within a range from 0.7 or more to 1.3 or less.

Although not illustrated in the drawings, the floating member 230 may have a protrusion serving as a supported portion, and the housing 240 may include a supporting portion having a recess.

The use of these configurations provides a scroll compressor capable of reducing inclination of the floating members 130 and 230 and capable of reducing the number of man-hours for assembly and manufacture, with a relatively simple structure.

Second Embodiment

A description will be given of a scroll compressor according to a second embodiment of the present invention. The scroll compressor according to the second embodiment is similar to the scroll compressor according to the first embodiment except for a structure of a floating member 330 and how a housing 340 supports the floating member 330. For this reason, the following description mainly concerns the structure of the floating member 330 and how the housing 340 supports the floating member 330.

The floating member 330 includes a body member 331 and an outer peripheral member 332 mounted to an outer periphery of the body member 331.

The body member 331 corresponds to the floating member 30 in the first embodiment from which the protrusion portions 30*b* are removed. The body member 331 is not described in the second embodiment.

The outer peripheral member 332 is separate from the body member 331. The outer peripheral member 332 is a flat plate member having an annular shape. The outer peripheral member 332 is fastened to the body member 331 with fixing means such as bolts (not illustrated).

The housing 340 surrounds an outer periphery of the outer peripheral member 332. The housing 340 supports at its inner peripheral face the outer peripheral member 332 such that the floating member 330 is slidable in an axial direction of a drive shaft 80.

Next, a description will be given of advantageous effects of the configuration described above.

For example, if the body member 331 is not separated from the outer peripheral member 332, but is integrated with the outer peripheral member 332, an outer periphery of the floating member occasionally undergoes, for example, strain after assembling the floating member into the scroll compressor 100. The occurrence of strain is apt to cause, for example, partial contact of an outer peripheral face of the floating member with an inner peripheral face of the housing 340. Ensuring a large clearance between the outer peripheral face of the floating member and the inner peripheral face of the housing 340 enables avoidance of the partial contact. In this case, however, the floating member is apt to be supported unsatisfactorily, so that the floating member 330 is apt to incline when moving in the vertical direction. This results in ununiform force of the floating member 330 to press the movable scroll 22.

According to the second embodiment, since the body member 331 is separate from the outer peripheral member 332, the outer peripheral member 332 is mounted to the body member 331 after the body member 331 is assembled into the scroll compressor 100. Hence, accuracy, such as roundness, for the outer peripheral member 332 is ensured even when the body member 331 undergoes, for example, strain in assembling the body member 331. The configuration described in the second embodiment therefore provides the scroll compressor 100 capable of reducing inclination of the floating member 330 and capable of reducing the number of man-hours for assembly and manufacture.

In the configuration described in the second embodiment, preferably, a ratio of a distance from a center of the outer peripheral member 332 to a center of a movable-side wrap 22*b* in the axial direction of the drive shaft 80 to a distance from a center of a bearing metal 32 to the center of the outer peripheral member 332 in the axial direction of the drive shaft 80 falls within a range from 0.5 or more to 1.5 or less. More preferably, the ratio falls within a range from 0.7 or more to 1.3 or less.

The scroll compressor according to the second embodiment may be implemented in conjunction with the modifications of the first embodiment insofar as there are no inconsistencies.

INDUSTRIAL APPLICABILITY

The present invention is useful as a scroll compressor in which a floating member presses a movable scroll against a fixed scroll, the scroll compressor being capable of reducing inclination of the floating member and being capable of reducing the number of man-hours for assembly and manufacture.

What is claimed is:

1. A scroll compressor comprising:

a compression mechanism including a fixed scroll including a fixed-side wrap having a spiral shape, and a movable scroll including a movable-side wrap having a spiral shape, the movable scroll together with the fixed-side wrap defining a compression chamber, the compression mechanism being configured to discharge a refrigerant compressed in the compression chamber;

a motor configured to drive the movable scroll to cause the movable scroll to revolve relative to the fixed scroll;

a drive shaft coupling the movable scroll to the motor;

a casing accommodating the compression mechanism, the motor, and the drive shaft therein;

a housing accommodated in the casing; and a floating member configured to be pushed toward the movable scroll by a pressure in a back pressure space, the back pressure space being formed between the floating member and the housing to press the movable scroll against the fixed scroll, the floating member including a pressing portion having a cylindrical shape configured to contact the movable scroll and to press the movable scroll against the fixed scroll, the pressing portion having a circumferential groove on an inner surface thereof, the floating member being supported by the housing, and one of the floating member including a plurality of supported portions arranged circumferentially at three or more locations, and the housing including a supporting portion supporting the supported portions of the floating member such that the floating member is slidable in an axial direction of the drive shaft and reducing inclination of the floating member, an outermost peripheral side face of the floating member not contacting an inner peripheral side face of the housing when the scroll compressor is in operation, or the floating member including a body member and an outer peripheral member separate from the body member, the outer peripheral member being mounted to an outer periphery of the body member, and the housing supporting the outer peripheral member such that the floating member is slidable in the axial direction of the drive shaft.

2. The scroll compressor according to claim 1, wherein each of the supported portions is a bush disposed on the floating member, and the supporting portion includes bolts respectively inserted into the bushes.

3. The scroll compressor according to claim 2, wherein the floating member further includes a bearing pivotally supporting the drive shaft, and a ratio of a first distance to a second distance falls within a range from 0.5 or more to 1.5 or less, the first distance is measured from a center of each bush to a center of the movable-side wrap in the axial direction of the drive shaft, and the second distance is measured from a center of the hearing to the center of each bush in the axial direction of the drive shaft.

4. The scroll compressor according to claim 1, wherein each of the supported portions is a ring disposed on the floating member, and the supporting portion includes control pins respectively inserted into the rings.

5. The scroll compressor according to claim 1, wherein each of the supported portions is a recess or a protrusion disposed in or on the floating member, and the supporting portion includes protrusions disposed on the housing and respectively fitted into the recesses in the floating member, or recesses disposed in the housing and into which protrusions on the floating member are respectively fitted.

* * * * *